US012426667B2

(12) United States Patent
Botta Aleman

(10) Patent No.: US 12,426,667 B2
(45) **Date of Patent: *Sep. 30, 2025**

(54) SOLE STRUCTURE AND FOOTWEAR HAVING SOLE STRUCTURE

(71) Applicant: Jose Botta Aleman, Miami, FL (US)

(72) Inventor: Jose Botta Aleman, Miami, FL (US)

( * ) Notice: Subject to any disclaimer, the term of this patent is extended or adjusted under 35 U.S.C. 154(b) by 98 days.

This patent is subject to a terminal disclaimer.

(21) Appl. No.: 18/107,464

(22) Filed: Feb. 8, 2023

(65) Prior Publication Data

US 2023/0180884 A1 Jun. 15, 2023

Related U.S. Application Data

(63) Continuation of application No. 15/942,827, filed on Apr. 2, 2018, now Pat. No. 11,576,460.

(51) Int. Cl.

| | |
|---|---|
| ***A43B 13/02*** | (2022.01) |
| ***A43B 5/12*** | (2006.01) |
| ***A43B 13/37*** | (2006.01) |

(52) U.S. Cl.

CPC ..... *A43B 13/023* (2013.01); *A43B 5/12* (2013.01); *A43B 13/37* (2013.01)

(58) Field of Classification Search

CPC ..... A43B 13/023; A43B 13/37; A43B 13/22; A43B 5/12; A43B 3/246

See application file for complete search history.

(56) References Cited

U.S. PATENT DOCUMENTS

| | | | | |
|---|---|---|---|---|
| 1,756,872 A * | 4/1930 | Mcgrail | ..... | A43B 23/227 36/148 |
| 2010/0293815 A1* | 11/2010 | Ferrigan | ..... | A43B 13/16 36/25 R |
| 2012/0137544 A1* | 6/2012 | Rosa | ..... | A43B 7/144 36/105 |

* cited by examiner

*Primary Examiner* — Uyen T Nguyen

(74) *Attorney, Agent, or Firm* — DP IP GROUP; Franco S. De Liguori

(57) ABSTRACT

The present invention is directed to a sole structure and an article of footwear having the sole structure. The footwear can be used as a dance or a general shoe. The sole structure includes protruding platforms arranged, oriented, and dimensioned to permit ruggedness, dancing, and substantial grippiness for both dance moves as well as general wear.

15 Claims, 5 Drawing Sheets

SOLE STRUCTURE AND FOOTWEAR HAVING SOLE STRUCTURE

CROSS-REFERENCE TO RELATED APPLICATION

This application is a continuation of U.S. application Ser. No. 15/942,827, filed Apr. 2, 2018, now U.S. Pat. No. 11,576,460, issued Feb. 14, 2023, the contents of which are incorporated herein by reference in their entirety.

BACKGROUND

Field

The present invention relates to the field of apparel and more specifically to the field of footwear.

Background Information

Dancing shoes have generally been considered to be a separate, specialized category of footwear. One does not dance in general shoes, and one does not wear dancing shoes except when dancing. The moves required for dancing necessitate that a dance shoe has specific characteristics. Many of these characteristics are undesirable for general footwear, such as smooth surfaces for sliding. Furthermore, dance shoes worn on non-dance occasions have a tendency to ruin the characteristics of the dance shoes that make them effective at dancing. There has not been an acceptable attempt to merge dance shoes and general shoes.

Therefore, there is a need for a shoe that can be worn while dancing and generally, while achieving the goals of both footwear.

SUMMARY

The present invention is directed to a shoe sole able to be worn as an everyday article of footwear and as an improved dance shoe. The sole includes a foot pad portion, an interstitial portion, and a heel portion. The distal sole base pad portion has several elements, including a major contact platform for controlled stops, a circular spinner platform for spinning dance motions along with radiating arc platforms for additional spin control, pad platforms for general use, a series of recession platforms that provide support for the receding, proximal end of the pad portion. The interstitial portion lacks significant protrusions and is elevated above the heel and pad portions. The heel portion includes an inclining heel peripheral platform circumscribing a substantially circular heel contact platform as well as an inclining central incline platform.

Therefore, there is a need for a sole that provides improved control in dance moves.

Furthermore, there is a need for a sole having improved wear patterns that do not fail over time.

Furthermore, there is a need for a sole having improved construction and comfort.

Furthermore, there is a need for a sole having improved construction able to withstand daily wear.

Furthermore, there is a need for a sole having reduced need to change shoes for dancing.

These aspects of the invention are not meant to be exclusive. Furthermore, some features may apply to certain versions of the invention, but not others. Other features, aspects, and advantages of the present invention will be readily apparent to those of ordinary skill in the art when read in conjunction with the following description, and accompanying drawings.

DETAILED DESCRIPTION

Figure 1:
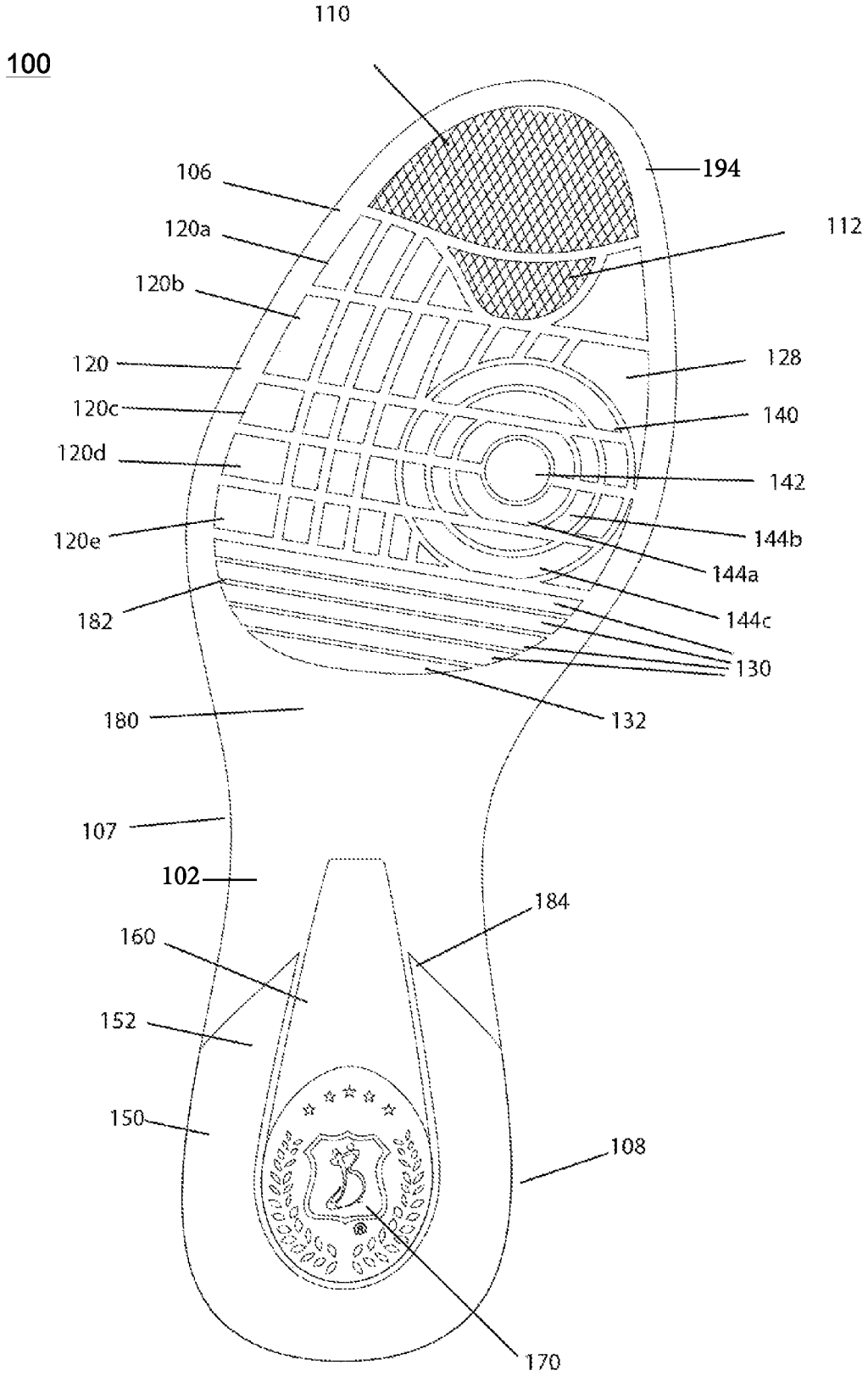
FIG. 1 is a plan view of the sole of the present invention.
Figure 2:
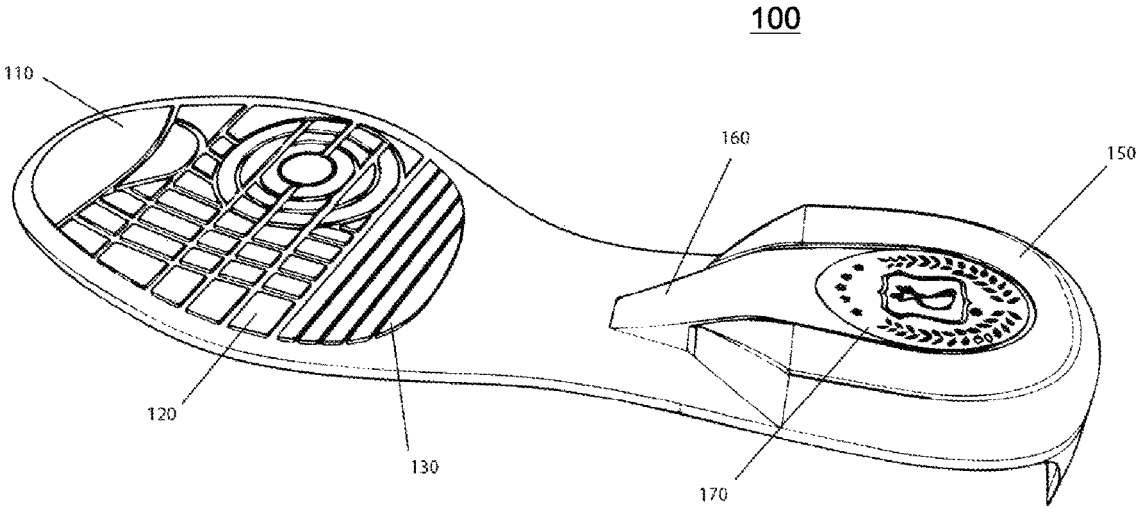
FIG. 2 is a perspective view of the sole of the present invention.
Figure 3:
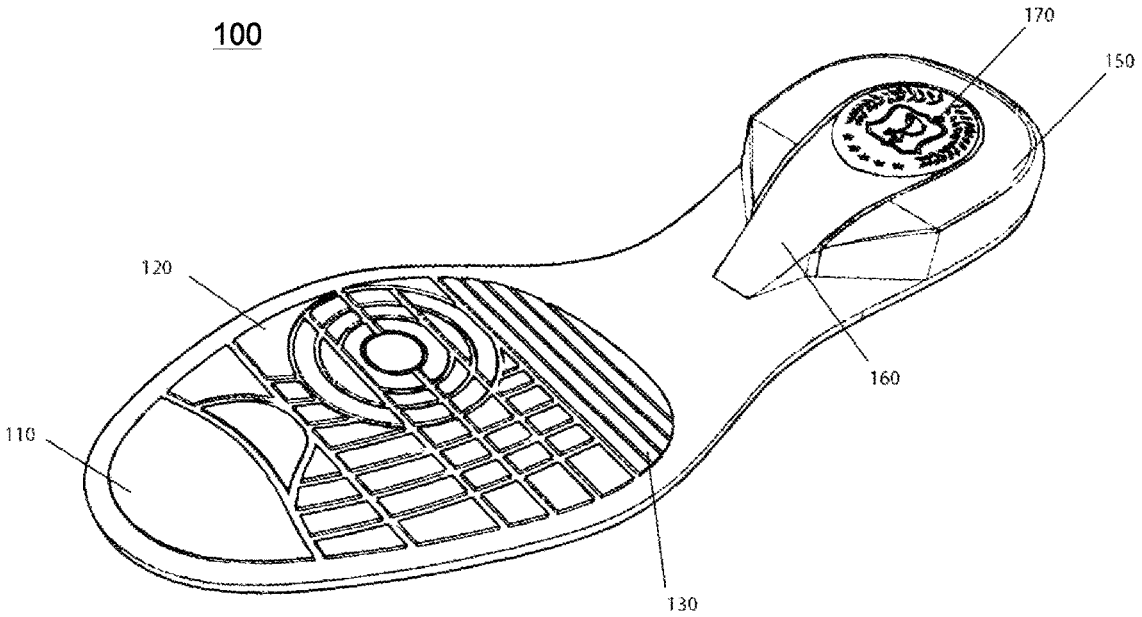
FIG. 3 is a perspective view of the sole of the present invention.
Figure 4:
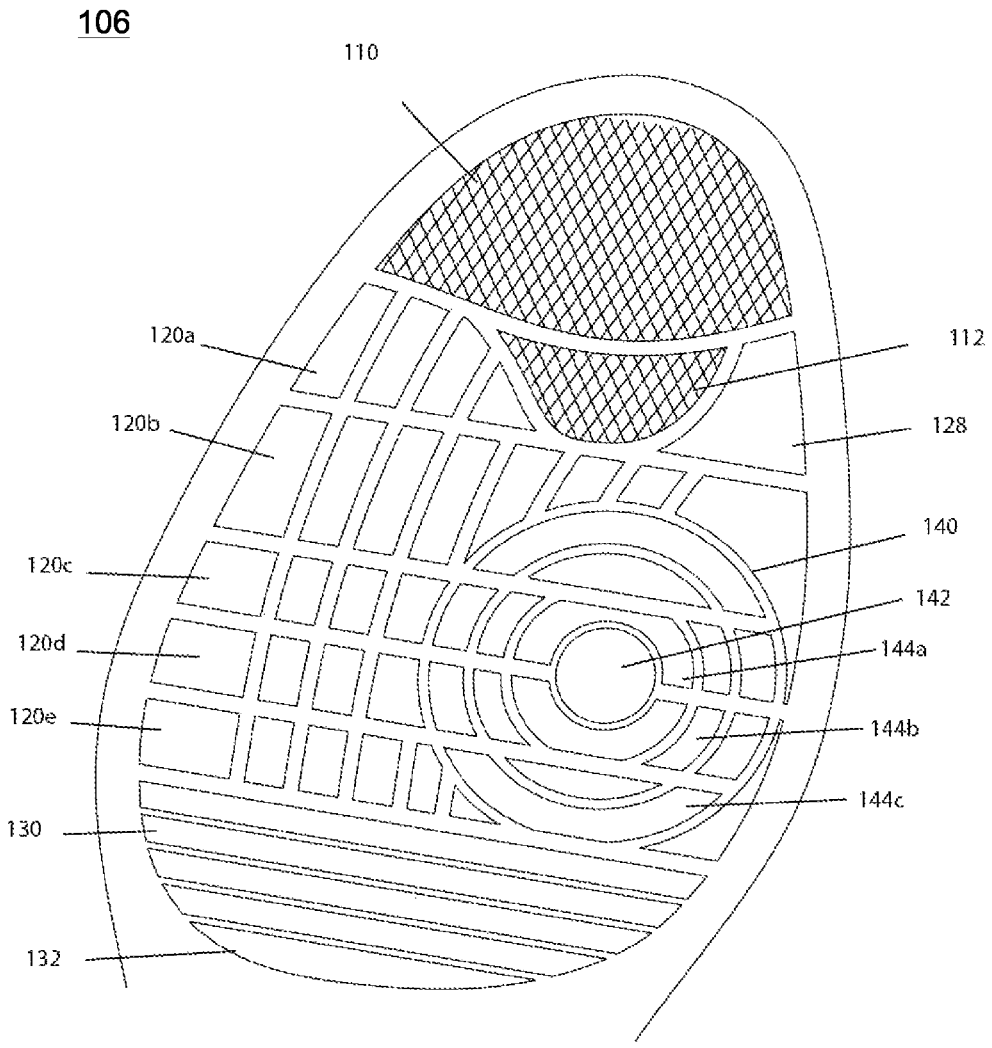
FIG. 4 is a portional, distal plan view of the sole of the present invention.

Referring first to FIG. 1, a basic embodiment of the shoe sole 100 is shown. The present invention fundamentally involves soles for dancing shoes that perform better than currently existing soles and can be worn daily. The present invention not only accomplishes the goals of traditional dance shoe suede sole bottoms, but also exceeds those goals. During the dance moves of spinning and twisting, the present invention provides relatively greater grip to stop and better foot placement control. This is largely due to the unique combination of flexibility, traction, and support on the proximal and distal regions of the sole. The sole includes an improved construction and comfort that minimizes wear while emphasizing dance performance.

The shoe sole 100 includes three portions, a foot pad portion 106, an interstitial portion 107, and a foot heel portion 108. These different portions of a shoe sole have specialized purposes both in general footwear and dance footwear.

Turning now to FIGS. 1-4 and 6, the footpad portion 106 of the present invention is specially designed to function as both general footwear and a dance shoe. As is the case in general footwear, the present invention includes pad platforms 120. Pad platforms 120 are those protrusions from the base 102 that form the primary basis of grip between footwear and the ground. Pad platforms are arranged about the foot pad 106 of the base 102. The preferred embodiment of the present invention includes multiple rows and columns of the pad platforms 120*a*, 120*b*, 120*c*, 120*d*, 120*e*. It is preferred that pad channels 182 run between the pad platforms 120 and run uninterrupted throughout the longitudinal and lateral portions of the shoe sole 100—except in limited circumstances. The pad platforms 120 are abutted by a contact platform 110, 112.

The major contact platform 110 is a substantially uninterrupted portion of the sole base 102 that protrudes at an approximately equal distance as the pad platforms 120. The major contact platform 110 includes a sinusoidal shape that conforms to the general curvature of the foot at the distal end of the sole. For purposes of the present disclosure, proximal includes those areas of the foot/sole closest to the ankle of the human body whereas distal includes those areas of the foot/sole farthest from the ankle. The sinusoidal shape is biased such that a uniform curve is not formed, but rather, the curve points in the direction of the interior of the human body, i.e., the area between the feet of a user. It is preferred that the contact platforms 110, 112 are unitary, and that the major contact platform 110 be uninterrupted by either lateral or longitudinal pad channels 182. Longitudinal and lateral pad channels provide flexibility and control, while the uninterrupted structure of platforms 110 and 112 produces gripping effect. In general, longitudinal channels allow for air flow for better motion of the foot, while lateral/traverse channels diminish resistance to bending and make for a very flexible sole.

Figure 6:
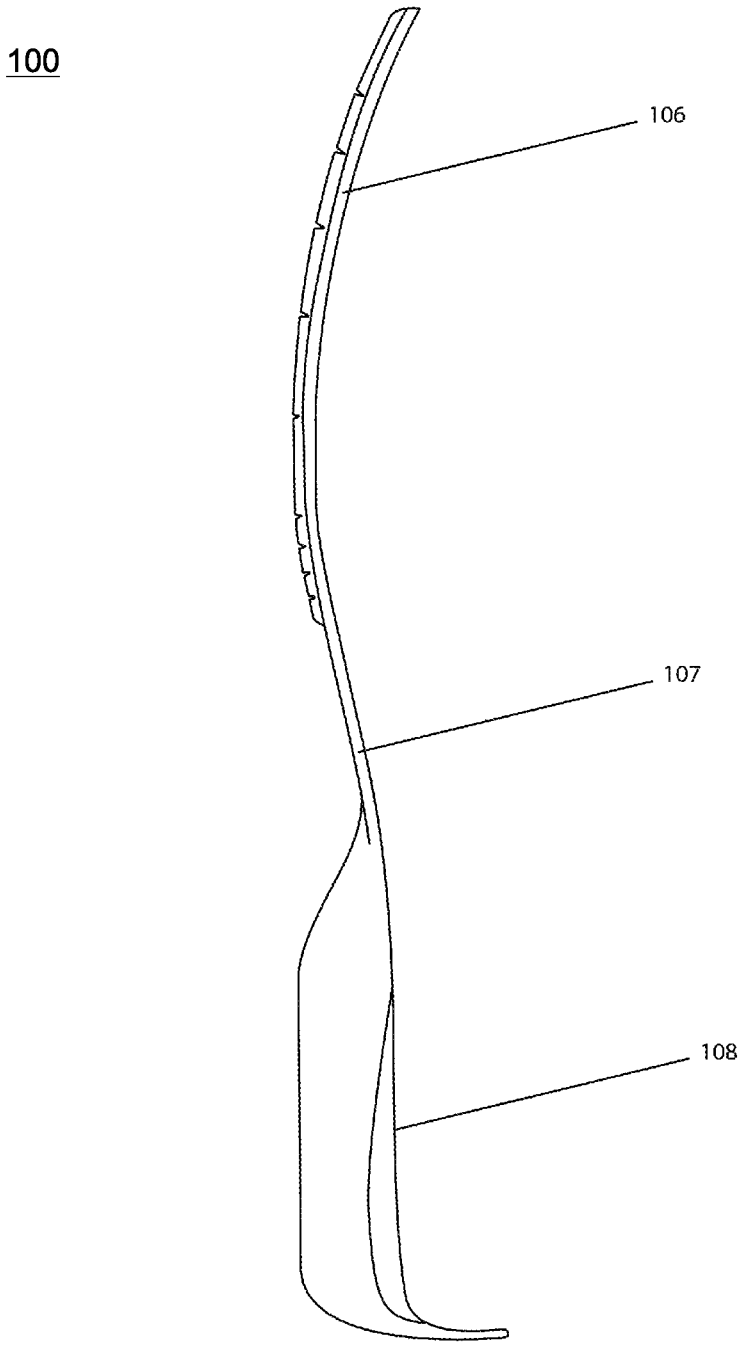
FIG. 6 is a side plan view of the sole of the present invention.

The major contact platform may protrude from one lateral portion of the sole to the other lateral portion of the sole and occupies that space between the toe mounds of the foot and the tips of the toes. With reference to FIG. 6, it is preferred that the portions occupied by the major platform 110 are elevated so they are not in contact with the ground in ordinary locomotion of a user's feet. The different platform portions of the distal portion of the sole 100 may be engulfed by periphery 194 that recedes beneath the platforms.

The elevation of the major contact platform permits the platform with a high coefficient of friction to be placed on a shoe and used only in situations requiring grippy surfaces. The grip of the contact platform should be significantly greater than the coefficient of friction of the pad platforms 120. The preferred gripping nature of the contact platform 110 is created by the use of an overlaid material or surface protrusions/perforations that create a high coefficient of friction. Preferred materials for use with the major contact platform include polyurethane and similar polymers. Polyurethane is light but highly abrasion-resistant and is excellent for hard-wearing shoe soles, with excellent long-term mechanical properties. Polyurethane soles are practical and keep water out, while permitting wide design potential. The sole may include preferred thickness of 3.0 mm as designed for daily wear and dance wear. The sole 100 may also feature a centralized supplement contact platform 112 distinct from the ultimately distal (i.e., farthest point) major contact platform and proximally located thereto. The supplemental contact platform 112 may be positioned between pad platforms, and preferably is so, and shares the lateral channeling, but not longitudinal channeling, characteristics therewith. The supplemental contact platform may be positioned on the portion of the sole that is in frequent common contact with the ground to enhance the grippiness of the sole, which is otherwise not provided by the pad platforms. The pad platforms are preferably perfectly smooth.

The pad platforms 120 additionally engulf another element of the sole 100, the pad spinner platform group 140. The pad spinner platform group 140 serves the purpose of permitting spin moves to be performed by the shoe bearing the sole 100. The group 140 includes two portions, a spinner center platform 142 and arcuate spinner secondary arc platforms 144 (144*a*, 144*b*, 144*c*) radiating therefrom. The spinner center platform 142 includes a substantially circular platform, in that it is either a circle or highly-rounded geometric figure, positioned proximate to the big toe mound to permit a dancer to spin without contacting a pad channel in ideal circumstances. However, because only experienced dancers can spin purely on the big toe mound, the radiating secondary arc platforms 144*a*, 144*b*, 144*c* provide additional support in the form of platforms that allow a largely unbroken pathway for the spinning of the sole about the center platform 142. Depending on the skill of a dancer, the dancer may invoke a one, two, or three layers or arc secondary platforms 144*a-c*. However, the purpose of channeling the protrusions of a sole are to permit shoe/sole flexibility. Although the inclusion of a limited area of unbroken protrusion, here the center spinner 142, may be appropriate, the arc secondary platforms 144 need some manner of separation. Channeling separate layers 144 laterally and longitudinally from the center spinner 142 and each other (144*a*, 144*b*, and 144*c*) so that the secondary arc platforms 144 appear similar to pad platforms 120, but with a portional circular orientation. Although it is preferred that they are not, if the secondary arc platforms 144 were joined, it is preferred that they would form a complete circle because there is symmetry throughout the circular portions. The texture of the spinner platform group is smooth with a relatively low coefficient of friction. It is preferred that the spinner group 140 be entirely engulfed by pad protrusions 120. Special pad protrusions 128 having dimensions and orientations that complement the circular spinner group platforms 140 are used to directly surround the spinner group 140 that allow substantial contact of the foot's edge to occur on the sole other than the spinner group 140.

Proximal to the pad platforms 120 and spinner platform group 140 are the recession platforms 130. The recession platforms 130 are preferably relatively smooth, non-grippy protrusions that run entirely laterally across the sole 100 to permit support for that portion of the sole that elevates upward in the proximate direction. The pad platforms may be completed with a recession platform supplement 132 that forms a sinusoidal shape biased to the distal, exterior inner portion of the feet.

Subsequent to the foot pad 106 is the interstitial pad 107. The interstitial pad 107 includes a transition plane that is free from protrusions because the sole of the present invention lacks a need for ground support in this area. In a preferred embodiment, there is a transition plane 180 that is unfettered with protrusions until the heel portion 108.

Figure 5:
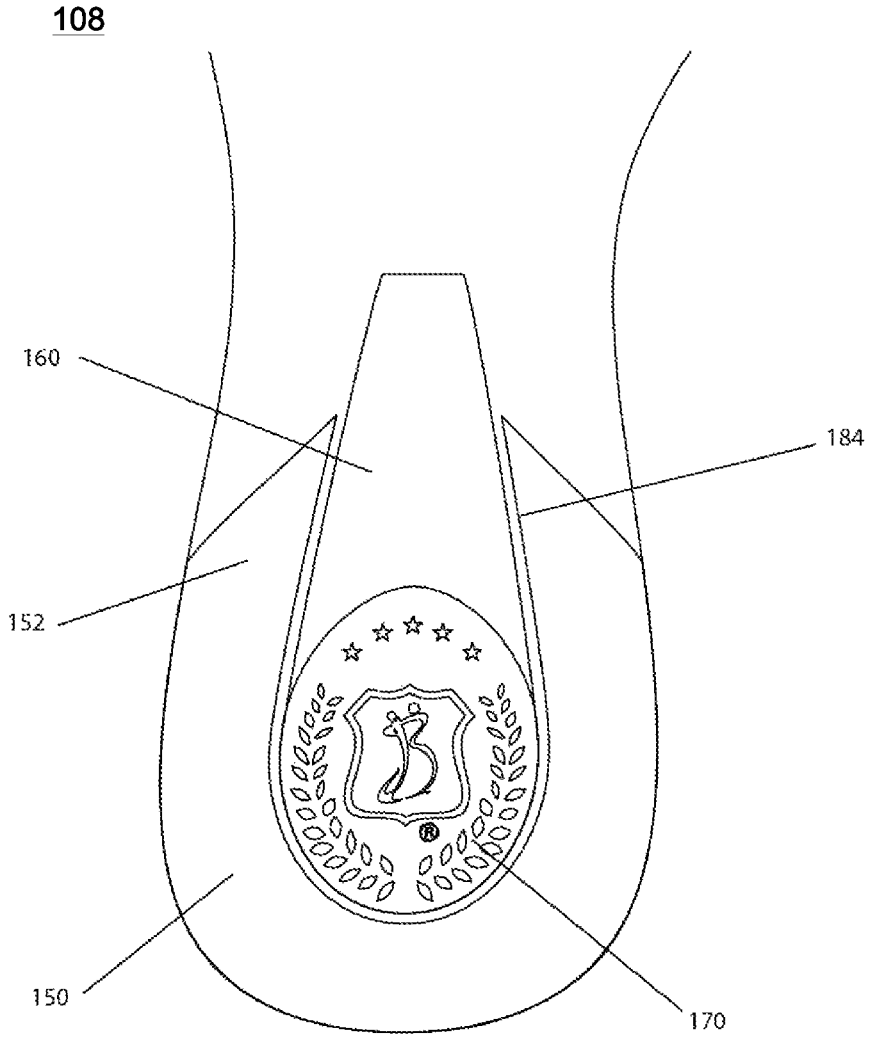
FIG. 5 is a portional, proximal plan view of the sole of the present invention.

Turning now to FIGS. 1, 5-6, the heel portion 108 of the sole 100 of the present invention includes a heel central incline platform 160 that gradually inclines to a heel contact platform 170. The heel contact platform 170 includes a substantially circular, preferably an ellipse as shown, platform that supports the central portion of the heel of a user's foot. The heel central incline platform 160 is positioned centrally within the sole so that it is relatively distant from the lateral edges of the sole. The central incline platform 160 and the heel contact platform 170 are engulfed by the heel peripheral platform 150 that is positioned at the lateral edges of the sole as well as the ultimate proximal portion of the sole. The heel peripheral platform 150 forms a horseshoe-like shape that allows primary contact with the ground. The heel contact platform 170 includes a preferably grippy texture that contrasts with the smooth texture of the incline central platform 160 and the heel peripheral platform 150, which also preferably inclines commensurate with the central platform. It is further preferred that the peripheral platform 150 expand from the center as it recedes proximally into a pair of platform wings 152. The heel portion of the shoe is preferably twenty mm, which is found to permit an excellent combination of good dance and wear performance.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein. However, because the preferred form of the present invention is depicted in the drawings of the present disclosure, a scale is provided that permits accurate relationships to be drawn between sole components.

The invention claimed is:

1. A sole structure for an article of footwear, the sole structure comprising:

a base configured to contact a ground surface;

a forefoot portion;

a heel portion including:

a first platform configured to support a central portion of a user's foot wearing a footwear bearing the sole structure;

a second platform gradually inclining toward the first platform and disposed in direct contact therewith so as to partially surround the first platform, the second platform being positioned centrally on the base and at a distance from lateral edges of the base; and a third platform surrounding the first platform and the second platform; and a central portion disposed between the forefoot portion and the heel portion;

wherein the forefoot portion includes:

a plurality of pad platforms protruding from the base and forming a primary basis of grip between the sole structure and the ground surface, the pad platforms being arranged in multiple rows and columns with lateral and longitudinal pad channels running therebetween, the lateral and longitudinal pad channels providing flexibility and control during use of a footwear bearing the sole structure;

a major contact platform protruding from the base so as to be uninterrupted by the lateral and longitudinal pad channels, the major contact platform having a coefficient of friction higher than that of the pad platforms for producing a gripping effect for controlled stops by the footwear bearing the sole structure;

a supplemental contact platform distinct from and disposed proximate to the major contact platform at a portion of the base configured for frequent contact with the ground surface to enhance a gripping effect of the sole structure, the supplemental contact platform being entirely disposed between and surrounded by an adjacent portion of the major contact platform and adjacent ones of the pad platforms so as to be spaced apart therefrom by selected ones of the pad channels; and a spinner platform group surrounded by the pad platforms and having a lower coefficient of friction relative to the major contact platform to permit spin moves to be performed by the footwear bearing the sole structure, the spinner platform group including a circular spinner center platform that permits spinning movements and arcuate spinner secondary arc platforms radiating from the spinner center platform to provide additional support allowing spinning of the footwear about the spinner center platform, the lateral pad channels being configured to run through the spinner platform group, except for the spinner center platform, to form the arcuate spinner secondary arc platforms.

2. The sole structure of claim 1, wherein the forefoot portion further includes a plurality of recession platforms configured to provide support for the pad platforms, the recession platforms comprising a plurality of smooth protrusions disposed proximate to and directly below the pad platforms and the spinner platform group, the protrusions being separated by lateral channels running laterally across the base.

3. The sole structure of claim 2, wherein the plurality of recession platforms are disposed parallel to one another.

4. The sole structure of claim 1, wherein the major contact platform is elevated so that it does not contact the ground surface during movement of a user's foot wearing a footwear bearing shoe sole structure, the major contact platform having a sinusoidal shape that is being configured to conform to a curvature of the user's foot at a distal end of the base.

5. The sole structure of claim 1, wherein the major contact platform does not laterally intersect the plurality of pad platforms.

6. The sole structure of claim 1, wherein the supplemental contact platform is laterally surrounded by adjacent ones of the pad platforms.

7. The sole structure of claim 1, wherein the forefoot portion further includes pad protrusions extending directly from a periphery of the base and directly surrounding the spinner platform group.

8. An article of footwear having the sole structure of claim 1.

9. A sole structure for an article of footwear, the sole structure comprising:

a base configured to contact a ground surface;

a forefoot portion;

a heel portion including:

a first platform configured to support a central portion of a user's foot wearing a footwear bearing the sole structure;

a second platform gradually inclining toward the first platform and disposed in direct contact therewith so as to partially surround the first platform, the second platform being positioned centrally on the base and at a distance from lateral edges of the base; and a third platform surrounding the first platform and the second platform; and a central portion disposed between the forefoot portion and the heel portion;

wherein the forefoot portion includes:

a plurality of pad platforms protruding from the base and forming a primary basis of grip between the sole structure and the ground surface;

a major contact platform protruding from the base and having a coefficient of friction higher than that of the pad platforms for producing a gripping effect for controlled stops by the footwear bearing the sole structure;

a supplemental contact platform distinct from and disposed proximate to the major contact platform at a portion of the base configured for frequent contact with the ground surface to enhance a gripping effect of the sole structure; and a spinner platform group surrounded by the pad platforms and having a lower coefficient of friction relative to the major contact platform to permit spin moves to be performed by the footwear bearing the sole structure, the spinner platform group including a circular spinner center platform that permits spinning movements and arcuate spinner secondary arc platforms radiating from the spinner center platform to provide additional support allowing spinning of the footwear about the spinner center platform, the lateral pad channels being configured to run through the spinner platform group, except for the spinner center platform, to form the arcuate spinner secondary arc platforms.

10. The sole structure of claim 9, wherein the pad platforms are arranged in multiple rows and columns with lateral and longitudinal pad channels running therebetween;

and wherein the major contact platform protrudes from the base so as to be uninterrupted by the lateral and longitudinal pad channels.

11. The sole structure of claim 10, wherein the lateral and longitudinal pad channels are configured to provide flexibility and control during use of a footwear bearing the sole structure.

12. The sole structure of claim 9, wherein the supplemental contact platform is entirely disposed between and surrounded by an adjacent portion of the major contact platform and adjacent ones of the pad platforms so as to be spaced apart therefrom by selected ones of the pad channels.

13. The sole structure of claim 9, wherein the forefoot portion further includes a plurality of recession platforms configured to provide support for the pad platforms, the recession platforms comprising a plurality of smooth protrusions disposed proximate to and directly below the pad platforms and the spinner platform group, the protrusions being separated by lateral channels running laterally across the base.

14. The sole structure of claim 13, wherein the plurality of recession platforms are disposed parallel to one another.

15. An article of footwear having the sole structure of claim 9.

* * * * *